US010858849B2

(12) United States Patent
Bautista

(10) Patent No.: US 10,858,849 B2
(45) Date of Patent: Dec. 8, 2020

(54) TOOL AND METHOD FOR FORMING SHOWER BASE ELEMENTS

(71) Applicant: Luis Bautista, Arlington, TX (US)

(72) Inventor: Luis Bautista, Arlington, TX (US)

( * ) Notice: Subject to any disclaimer, the term of this patent is extended or adjusted under 35 U.S.C. 154(b) by 293 days.

(21) Appl. No.: 15/880,755

(22) Filed: Jan. 26, 2018

(65) Prior Publication Data

US 2018/0238065 A1 Aug. 23, 2018

Related U.S. Application Data

(60) Provisional application No. 62/461,374, filed on Feb. 21, 2017.

(51) Int. Cl.

| | |
|---|---|
| ***E04G 21/16*** | (2006.01) |
| ***B28B 1/29*** | (2006.01) |
| *A47K 3/28* | (2006.01) |
| *A47K 3/40* | (2006.01) |
| *E04G 21/20* | (2006.01) |

(52) U.S. Cl.
CPC ..... *E04G 21/167* (2013.01); *B28B 1/29* (2013.01); *A47K 3/283* (2013.01); *A47K 3/405* (2013.01); *E04G 21/201* (2013.01)

(58) Field of Classification Search
CPC ..... E04G 21/167
See application file for complete search history.

*Primary Examiner* — Larry W Thrower
(74) *Attorney, Agent, or Firm* — William Lovin & Assoc., LLC; William R. Lovin

(57) ABSTRACT

A tool and a method for creating a base element for a shower installation are disclosed. Specifically, the tool relates to a multi-level, rotary mounted form arm and an edge support for forming mortar into a properly sloped shower base.

6 Claims, 5 Drawing Sheets

TOOL AND METHOD FOR FORMING SHOWER BASE ELEMENTS

CROSS-REFERENCE TO RELATED APPLICATIONS

This application makes reference to U.S. Prov. Pat. No. 62/461,374 filed Feb. 21, 2017 and incorporates it in its entirety by reference.

FIELD OF THE INVENTION

The present invention relates to a tool and a method for creating a base element for a shower installation. Specifically, the present invention relates to a multi-level, rotary mounted form arm and an edge support for forming mortar into a properly sloped shower base.

BACKGROUND OF THE INVENTION

Currently, there are numerous methods of creating a drain pan for a shower installation. There are monolithic, precast products that make it possible to install a pre-made, properly sloped drain pan in a shower stall. Such products are installed, taped, and finished leaving a properly sloped drain pan ready for final tiling. Unfortunately, such products are costly.

Fixed dimension, non-tiled shower pans are constructed out of nylon reinforced fiber or plastic. These are installed directly on the slab. These products are reasonably priced. But their construction is not useful for tiled shower pans.

The most common method is for a concrete worker to form a properly sloped pre-shower slope element from mortar in the area where the shower stall is to be placed. Next, the concrete worker places a plastic shower liner down over the dried pre-drain element in the base of the shower stall. This shower liner conducts water that makes its way through the subsequently poured drain element and tiled floor to the drain. Next, the concrete worker forms the final properly sloped drain pan of the shower stall out of mortar. Finally, tile installers install tile over the drain pan of the shower stall.

This method is, however, very labor intensive and dependent on the skill of the artisan forming the mortar elements. What is needed then is a tool and a method of using the tool that facilitates and simplifies forming these elements of the base.

Therefore, what is needed is a tool and a method of using the tool that facilitates forming a properly angled pre-shower slope capable of supporting a plastic drain liner.

Also, what is needed is a tool and a method of using the tool that facilitates forming a properly angled shower pan on top of the plastic drain liner.

Finally, what is needed is a height-adjustable support element capable of being aligned such that drain pans of various lengths and widths may be formed.

SUMMARY OF THE INVENTION

The exemplary embodiment of the present invention comprises two components: 1) A rotary mounted form tool; and, 2) A height-adjustable support structure capable of being aligned to support the rotating end of the rotary forming tool.

The rotary mounted forming tool is comprised of a central mount capable of being affixed to the drain flange and drain riser of a shower stall. The central mount has a vertical shaft affixed to it via a moveable joint. The central mount may be affixed directly to a drain flange and subsequently affixed to the drain riser.

Horizontally attached to the vertical shaft of the drain mount is a length-adjustable form arm. An adjustment screw end support may be vertically screwed through the terminal end of the form arm and is capable of supporting the terminal end of the form arm. An adjustment screw is used to fix the height of the end affixed to the vertical shaft.

The height-adjustable support structure is a plastic strip capable of being placed on the ground around the shower area. Cut into the strip at regular distances along its length are a series of vertical slots of different lengths. Placed crosswise into these slots at regular distances from one another are stabilizing elements. These stabilizing elements adjust the height of the height-adjustable support structure at various points on its outer periphery when it is installed.

The exemplary embodiment of the present invention is used in the following manner: First, the central mount of the rotary mounted forming tool is attached to the roughed in drain flange. Next, the length-adjustable form arm is inserted on the vertical shaft. Next, the fixing adjustment screw and the adjustment screw end support are adjusted so that the grade formed by the pre-shower slope is within code for a pre-shower slope. Next, the user mixes mortar and pours it into the shower pan area. Next, the user rotationally positions the form arm to mold a pre-shower slope. Next the user removes the rotary mounted form tool and length-adjustable form arm. Next, the user lets the pre-shower slope dry. Next, the user positions a shower liner over the cured pre-shower slope. Next, the user secures a shower liner lock plate over the drain flange. Next, the user positions a drain riser in the drain flange at the proper height. Next, the user removes the adjustment screw from the end of the form arm. Next, the user affixes the rotary mount form tool in the drain riser at the proper height and secures the fixing adjustment screw. Next, the user places the height-adjustable support structure around the peripheral extent of the shower pan area. Next, the user inserts stabilizing elements through vertical slots at suitable points along the length of the height-adjustable support structure to adjust the height of the height-adjustable support structure to reflect the proper code specified for the final grade of the shower pan. Next, the user mixes mortar and pours it into the shower pan area. Next, the user rotationally flexes the form arm to mold a shower pan. Next the user removes the rotary mounted form tool and length-adjustable form arm. Next, the user lets the shower pan dry. Finally, the tile installer installs tile over the cured shower pan.

DETAILED DESCRIPTION OF THE PREFERRED EMBODIMENT

Figure 1A:
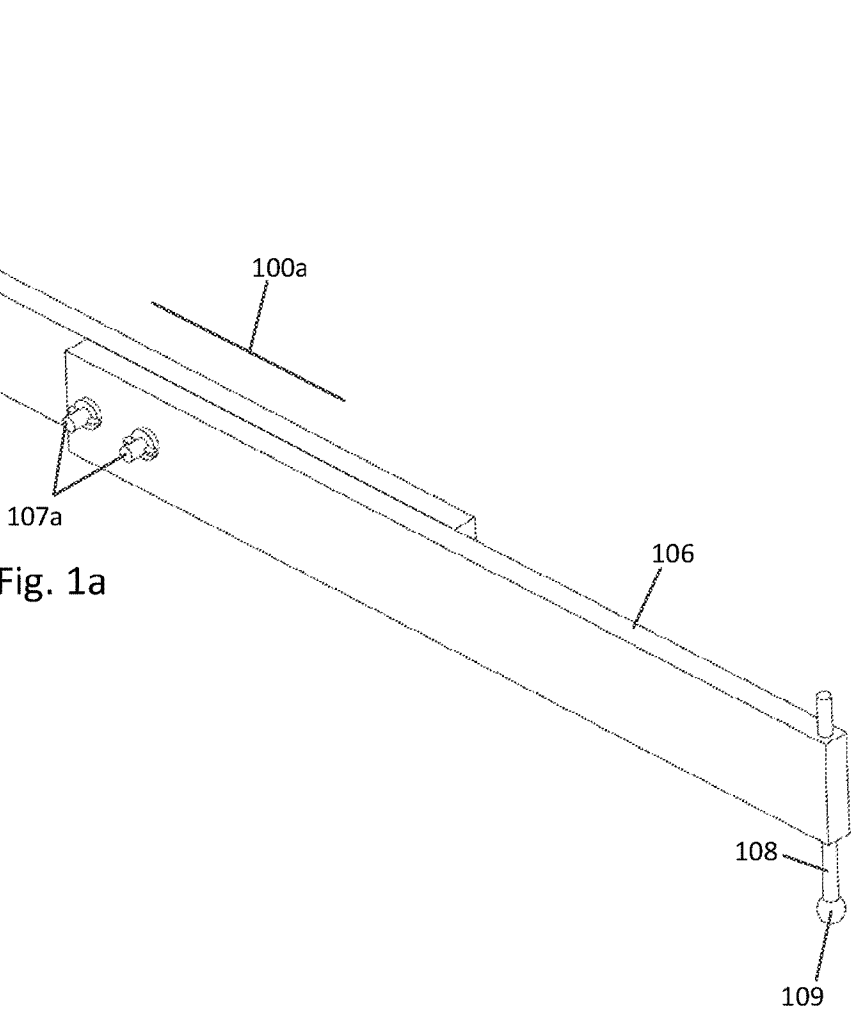
FIG. 1*a* is a diagram showing the rotary mounted form tool and length-adjustable form arm.
Figure 1B:
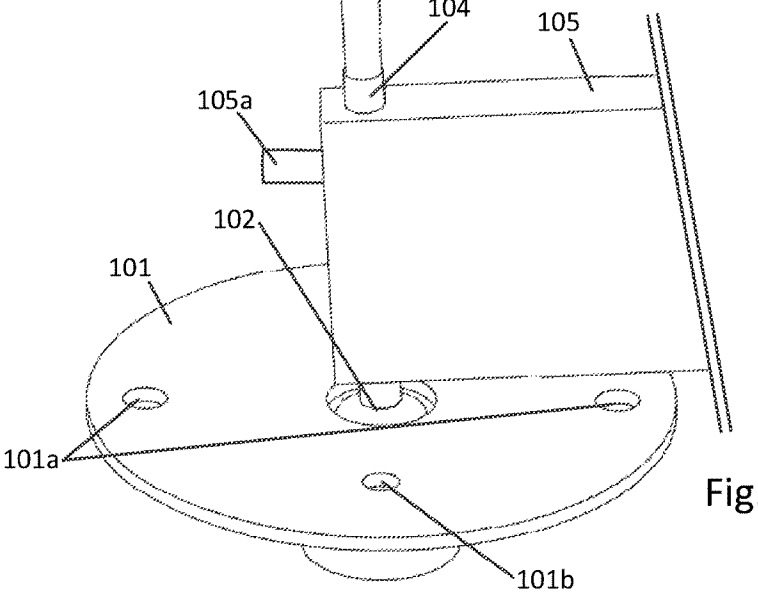
FIG. 1*b* is close-up diagram showing the rotary mounted form tool.

Referring now to FIGS. 1 through 5 the exemplary embodiment of the present invention comprises two components: 1) A rotary mounted forming tool 100; and, 2) A height-adjustable support structure 140 capable of being aligned to support the rotating end of rotary mounted forming tool 100.

Rotary mounted forming tool 100 is comprised of central mount 101 capable of being affixed to drain flange 110 and drain riser 131 of a shower stall. Central mount 101 has vertical shaft 103 affixed to it via ball joint 102. Central mount 101 may be affixed directly to drain flange 110 and subsequently affixed to drain riser 131. Central mount 101 has two sets of holes: 1) A first set 101*a* driven such that central mount 101 may be affixed by bolts to drain flange 110; and, 2) A second set 101*b* driven such that central mount 101 may be affixed by screws to drain riser 131.

Horizontally attached to vertical shaft 103 of central mount 101 is length-adjustable form arm 100*a*. Vertical shaft 103 is equipped with visual markings showing the height of length-adjustable form arm 100*a* above central mount 101. Vertical shaft 103 is affixed to central mount 101 by means of ball joint 102. Length-adjustable form arm 100*a* is comprised of near arm 105 and distal arm 106. Length-adjustable form arm 100*a* is attached to vertical shaft 103 at central pivot hole 104. Length-adjustable form arm 100*a* is secured to vertical shaft 103 by means of adjustment screw 105*a*. It will be obvious to one having skill in the art that adjustment screw 105*a* is not the only means of affixing length-adjustable form arm 100*a* to vertical shaft 103. Pins or clips may also be used in lieu of adjustment screw 105*a*. Near arm 105 and distal arm 106 are adjustably affixed together by screws 107*a*. Screws 107*a* are inserted through holes and adjustable length slot 107*b*. It will be obvious to one having skill in the art that the holes may be drilled in either near arm 105 or distal arm 106. Similarly, adjustable length slot 107*b* is formed in the opposing distal arm 106 or near arm 105. Adjustment screw end support 108 may be vertically screwed through the terminal end of distal arm 106 and is capable of supporting the terminal end of distal arm 106 and attached near arm 105 by means of its affixed terminal pad 109.

Figure 2:
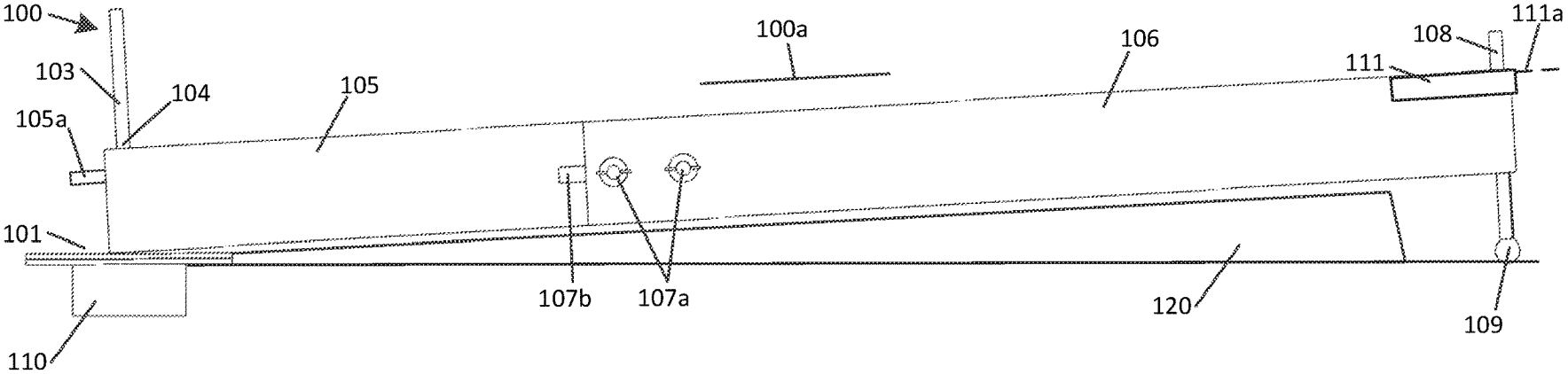
FIG. 2 is an elevation view showing the rotary mounted form tool and length-adjustable form arm being used to mold a pre-shower slope.
Figure 3:
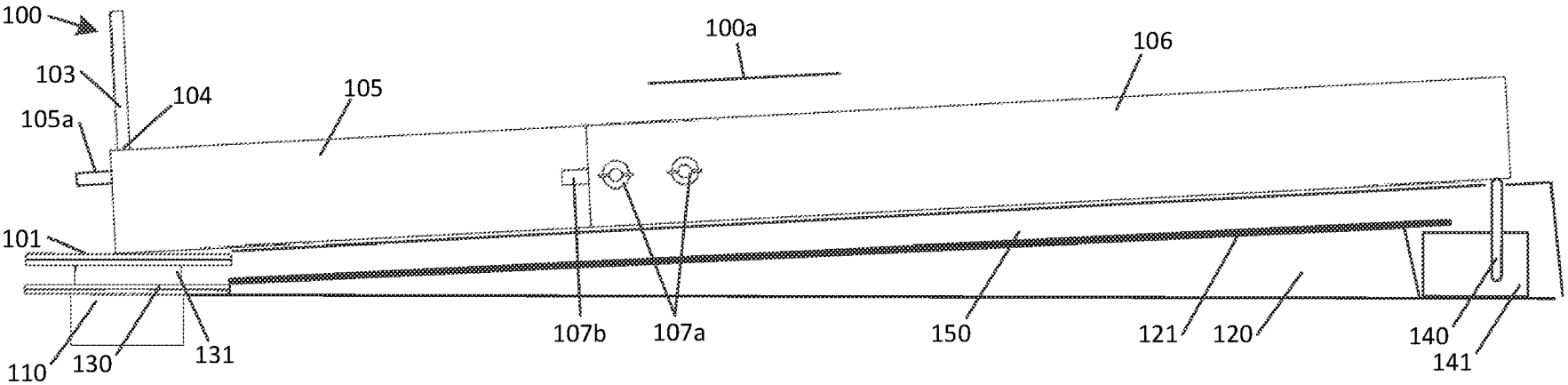
FIG. 3 is an elevation view showing the rotary mounted form tool and length-adjustable form arm being used to mold a shower pan area.

Referring specifically to FIG. 2, in an alternative embodiment of the present invention is disclosed. In this embodiment, laser 111 generating laser point 111*a* may be affixed to the distal end of distal arm 106. Laser point 111*a* is projected onto the side of the shower enclosure.

Figure 4:
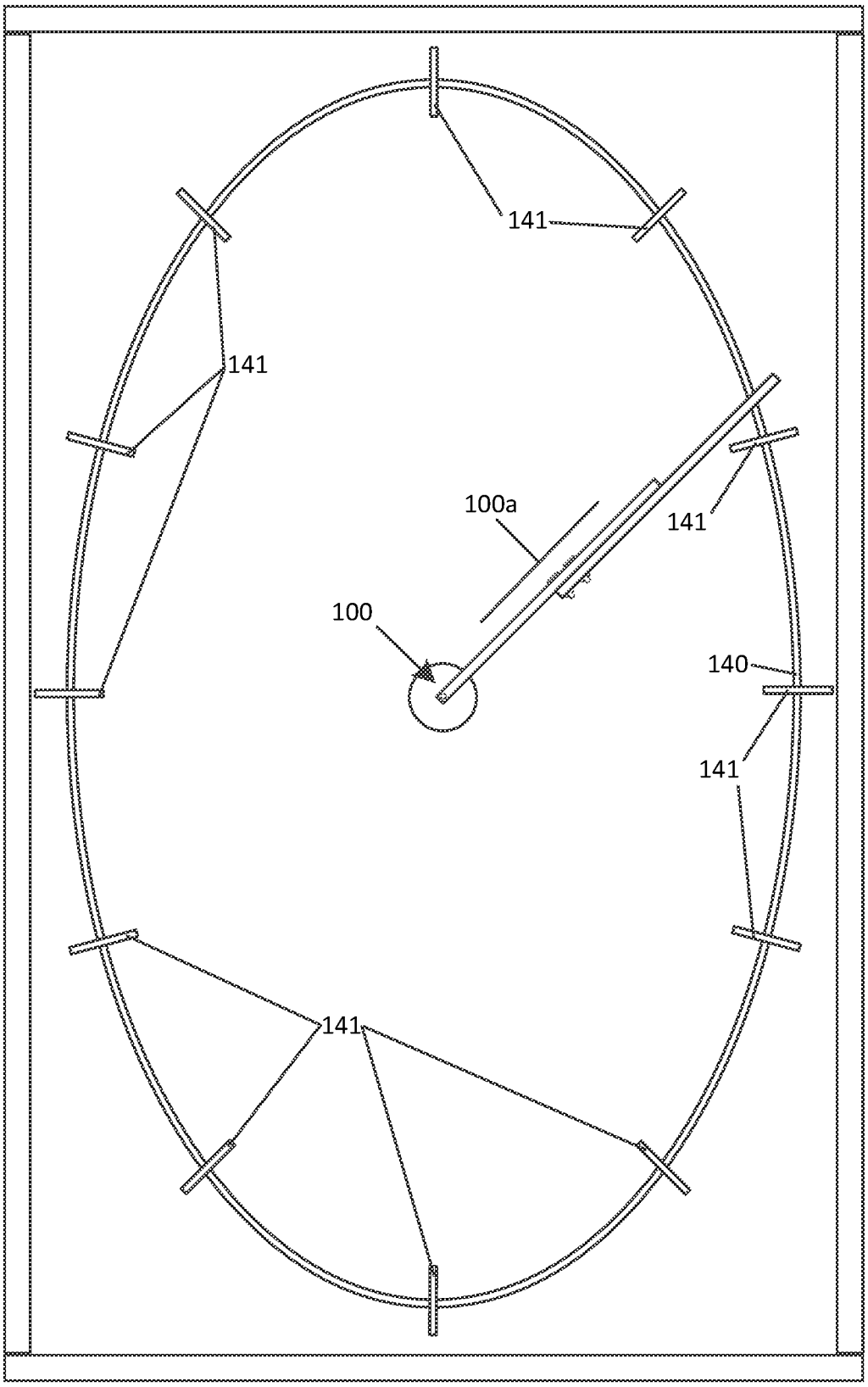
FIG. 4 is a plan view showing the rotary mounted form tool and length-adjustable form arm in typical relation to the height-adjustable support structure with stabilizing elements.
Figure 5:
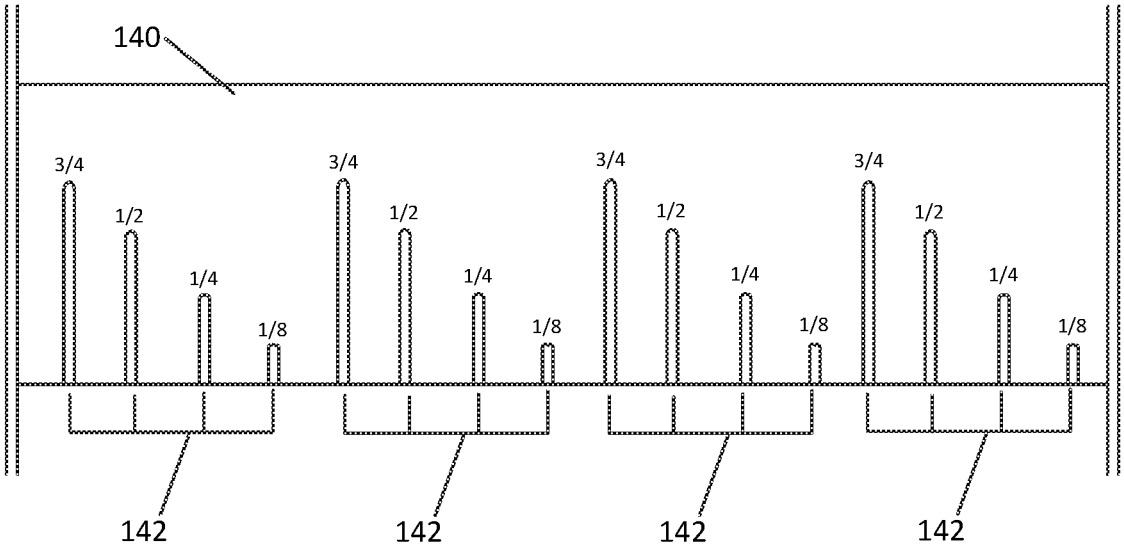
FIG. 5 is an elevation view showing the height-adjustable support structure slotted to support stabilizing elements.

Referring now to FIGS. 4 and 5, height-adjustable support structure 140 is a plastic strip capable of being placed on the ground around the outer perimeter of the shower area. Cut or molded into height-adjustable support structure 140 at regular distances along its length are repeating series of vertical slots 142. Each slot in each series of repeating series of vertical slots 142 are different lengths. For example, the preferred embodiment of the present invention has slots that are ⅛", ¼", ½", and ¾" long and each slot is placed ½" apart. Placed crosswise into these slots at regular distances from one another are stabilizing elements 141. Stabilizing elements 141 are used to adjust the height of height-adjustable support structure 140 at various points on its outer circumference when it is installed.

Referring again to FIGS. 1 through 5, the exemplary embodiment of the present invention is used in the following manner: First, central mount 101 of rotary mounted forming tool 100 is attached to roughed in drain flange 110. Next, central pivot hole 104 of length-adjustable form arm 100*a* is inserted on vertical shaft 103. Next, fixing adjustment screw 105*a* and adjustment screw end support 108 are adjusted so that the grade formed by length-adjustable form arm 100*a* is within code for a pre-shower slope. The user tightens fixing adjustment screw 105*a*. Next, the user mixes mortar and pours it into the shower pan area. Next, the user rotates length-adjustable form arm 100*a* around vertical shaft 103 to mold a pre-shower slope. Next the user removes rotary mounted forming tool 100 and length-adjustable form arm 100*a* from roughed in drain flange 110. Next, the user lets the pre-shower slope dry. Next, the user positions shower liner 121 over cured pre-shower slope 120. Next, the user secures shower liner 121 using shower liner lock plate 130 over drain flange 110. Next, the user positions drain riser 131 in shower liner lock plate 130 at the proper height. Next, the user removes adjustment screw end support 108 from the distal end of length-adjustable form arm 100*a*. Next, the user screws rotary mounted forming tool 100 to drain riser 131. Next, the user places height-adjustable support structure 140 around the peripheral extent of the shower pan area. Next, the user inserts stabilizing elements 141 through vertical slots 142 at suitable points along the length of height-adjustable support structure 140 to adjust the height of height-adjustable support structure 140 such that the grade formed by length-adjustable form arm 100*a* as it rests with its distal end on top of height-adjustable support structure 140 that is set in compliance with the proper code specified for the final grade of the shower pan. Next, the user mixes mortar for shower pan 150 and pours it into the shower pan area. Next, the user rotationally flexes length-adjustable form arm 100*a* on top of and around height-adjustable support structure 140 to mold a shower pan. Next, the user removes rotary mounted forming tool 100 and length-adjustable form arm 100*a* from drain riser 131. Next, the user lets the shower pan dry. Finally, the tile installer installs tile over the cured shower pan 150.

Referring now specifically to FIG. 2, an alternative embodiment of the present invention is used in an alternative manner: Specifically, laser point 111*a* generated by laser 111 is aligned with level lines drawn on the sides and end of the shower stall. This is done both to form both pre-shower slope 120 and to form the shower pan. Height-adjustable support structure 140 is not required using this embodiment.

While the present invention has been described in what are thought to be the most useful and practical embodiments, it will be readily apparent to those having skill in the art that other variations may be readily conceived and created. Accordingly, these and all such other readily conceived and created variations are implicitly included in the spirit and scope of the present disclosure.

What is claimed is:

1. A system for forming and constructing a shower pan comprising:

a) a rotary mounted forming tool comprising a generally perpendicular vertical shaft with radially affixed length-adjustable form arm wherein said radially affixed length-adjustable form arm is affixed at one end to said vertical shaft;

b) an adjustment screw end support affixed at a terminal end of said radially affixed length-adjustable form arm; and c) a height-adjustable support structure with affixed stabilizing elements wherein said stabilizing elements are transversely inserted through slots formed in said height-adjustable support structure.

2. The system for forming and constructing the shower pan of claim 1 wherein the generally perpendicular vertical shaft is anchored at a drain flange of the shower pan.

3. The system for forming and constructing the shower pan of claim 1 wherein the radially affixed length-adjustable form arm is constructed of wood.

4. The system for forming and constructing the shower pan of claim 1 wherein the radially affixed length-adjustable form arm is constructed of aluminum.

5. The system for forming and constructing the shower pan of claim 1 wherein the radially affixed length-adjustable form arm is constructed of fiberglass.

6. The system for forming and constructing the shower pan of claim 1 wherein:

a) the length-adjustable form arm is supported at the terminal end by an adjustment screw end support to form a pre-shower slope; and b) the length-adjustable form arm is supported at the terminal end by a height-adjustable support structure with affixed stabilizing elements to form the shower pan.

* * * * *